US006508381B1

(12) United States Patent
Sadi

(10) Patent No.: US 6,508,381 B1
(45) Date of Patent: Jan. 21, 2003

(54) BAG DISPENSING ASSEMBLY

(76) Inventor: Ahmed Sadi, 2332 E. 21st St., Signal Hill, CA (US) 90806

( * ) Notice: Subject to any disclaimer, the term of this patent is extended or adjusted under 35 U.S.C. 154(b) by 94 days.

(21) Appl. No.: 09/723,240

(22) Filed: Nov. 28, 2000

(51) Int. Cl.[7] ..... A47K 10/24
(52) U.S. Cl. ..... 221/45; 221/282
(58) Field of Search ..... 221/33, 45, 63, 221/282, 283; 206/554

(56) References Cited

U.S. PATENT DOCUMENTS

| | | | | | |
|---|---|---|---|---|---|
| 2,788,822 | A | | 4/1957 | Parker | |
| 3,121,511 | A | * | 2/1964 | Whitehead | 221/283 |
| 3,191,805 | A | * | 6/1965 | Stanley | 221/283 |
| 3,258,156 | A | | 6/1966 | Smith | |
| 3,307,740 | A | * | 3/1967 | Fant | 221/282 |
| 3,384,224 | A | | 5/1968 | Buckholz et al. | |
| 3,826,361 | A | | 7/1974 | Heckrodt | |
| 4,453,649 | A | | 6/1984 | Origuchi | |
| 4,574,952 | A | | 3/1986 | Masui | |
| 4,597,494 | A | | 7/1986 | Benoit | |
| 5,353,950 | A | | 10/1994 | Taylor et al. | |
| 5,509,570 | A | * | 4/1996 | DeMatteis | 221/33 |
| 5,562,211 | A | | 10/1996 | Simons et al. | |
| 5,613,608 | A | | 3/1997 | Tronchetti et al. | |
| 5,671,847 | A | | 9/1997 | Pedersen et al. | |
| 5,740,913 | A | | 4/1998 | McFarland | |
| 6,179,126 | B1 | * | 1/2001 | Smithson et al. | 206/554 |

* cited by examiner

*Primary Examiner*—Kenneth W. Noland
(74) *Attorney, Agent, or Firm*—Oliff & Berridge, PLC

(57) ABSTRACT

A compact bag dispensing assembly may be conveniently mounted on a mounting surface, such as a dashboard or console panel of an automobile. A plurality of bag structures are held by a mounting structure, which may be a box or the like. The mounting structure has an adhesive strip or the like that allows the mounting structure to be attached to the mounting surface. The bag structures may be attached together by adhesive or the like at one end. The mounting structure allows a single bag at a time to be removed. Each bag structure may be folded upon itself one or more times so as to fit within a mounting structure of smaller dimensions than the bag structure dimensions.

20 Claims, 4 Drawing Sheets

BAG DISPENSING ASSEMBLY

BACKGROUND OF THE INVENTION

1. Field of Invention

This invention relates to dispensing bags.

2. Description of Related Art

Many people spend a comparatively large amount of time in relatively small or confined areas, such as automobiles, workplace cubicles or the like. Most of these people desire to keep these areas clean, organized and free of trash. However, since these spaces are often small and/or odd-shaped, especially in the case of an automobile interior, a conventional trash can may not be practical as a trash receptacle. Some individuals periodically take a trash bag to the area to collect trash, but this is inconvenient and does not solve the problem of consolidating trash on a continual basis. Other individuals hang a trash bag from an automobile console knob or the like to provide an always-present trash receptacle, but when the bag is full and is discarded, the individuals often forget to take another trash bag to the area. Furthermore, since such confined areas often have extremely limited storage space, the individuals may be reluctant or unable to store replacement bags in the area itself e.g., there may not be room in the glove compartment of an automobile to store extra bags.

SUMMARY OF THE INVENTION

This invention provides a compact bag dispensing assembly that may be conveniently mounted on a mounting surface. A plurality of bag structures are held by a mounting structure that may be attached to the surface.

The bag structures may be attached together by adhesive or the like at one end. The mounting structure, which may be a box or the like, holds the bags and allows a single bag at a time to be removed.

The attached end of each bag structure may be an attachment portion, which may be detachable from a bag portion of the bag structure. Each bag structure may be folded upon itself one or more times so as to fit within a mounting structure of smaller dimensions than the bag dimensions.

These and other objects, advantages and salient features of the invention are described in or are apparent from the following description of preferred embodiments.

BRIEF DESCRIPTION OF THE DRAWINGS

The invention will be described with reference to the drawings, in which.

DETAILED DESCRIPTION OF PREFERRED EMBODIMENTS

This invention provides a compact bag dispensing assembly that may be conveniently mounted on a surface.

Figure 1:
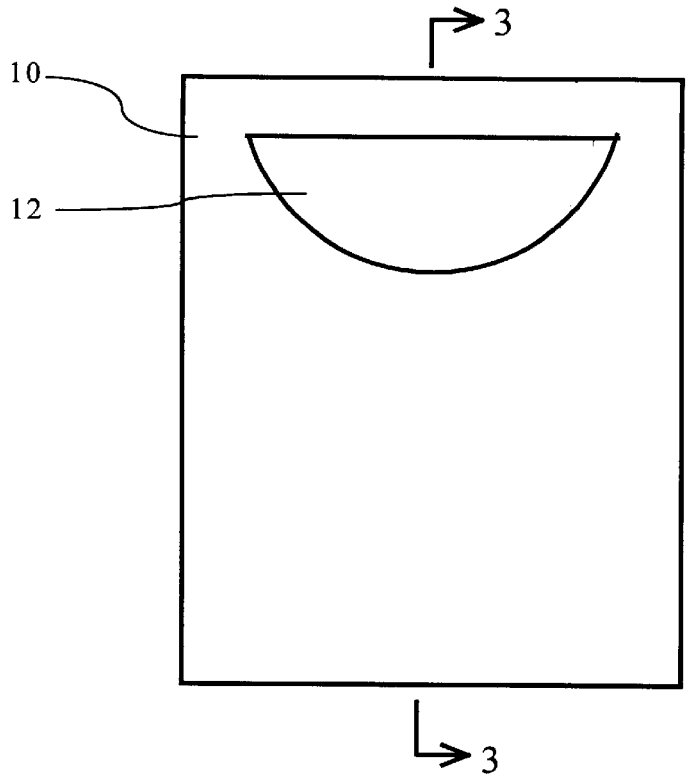
FIG. 1 shows a front view of a bag dispensing assembly.

FIG. 1 shows a front view of an exemplary bag assembly, including a mounting structure 10 that may, for example, be a box made of thin cardboard, plastic or other suitable material. An opening 12 in the mounting structure allows bag structures stored in the mounting structure 10 to be removed. The opening 12 is shown to have a shape corresponding to one side of a circle, but any other suitable shape that allows a user access to the interior of the mounting structure 10 may also be used.

Figure 2:
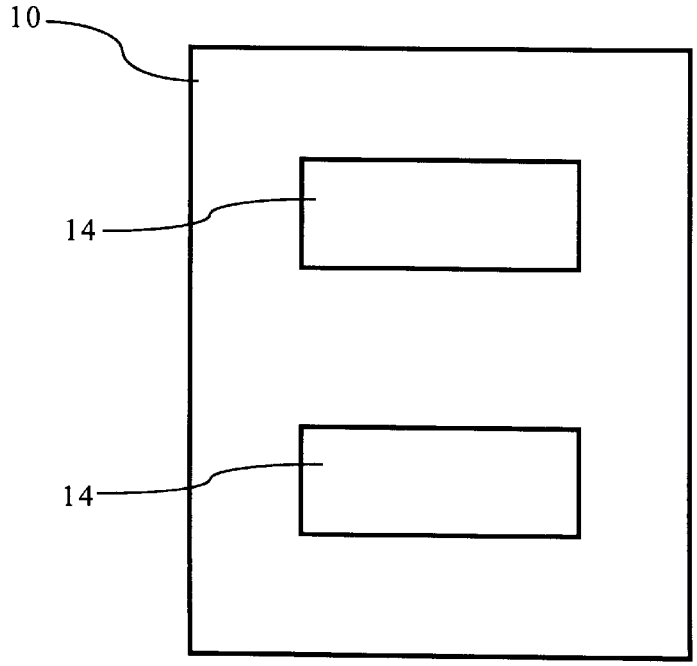
FIG. 2 shows a rear view of the bag dispensing assembly of FIG. 1.
Figure 3:
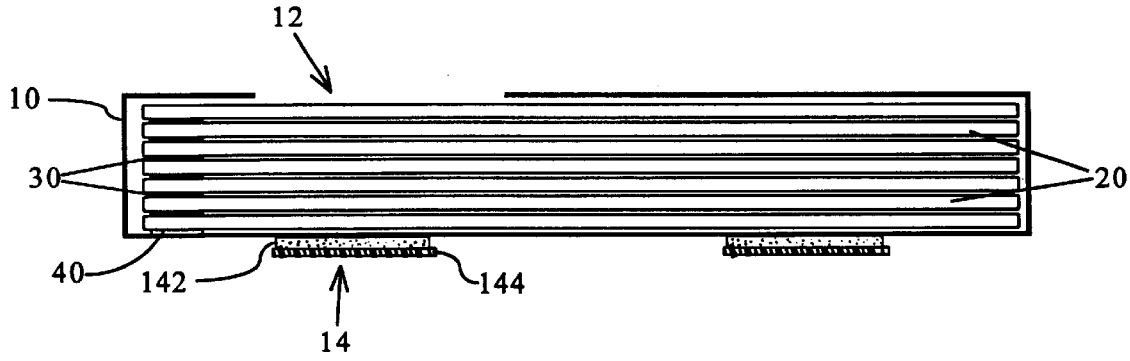
FIG. 3 shows a cross-sectional view along line 3—3 of FIG. 1.

FIG. 2 shows a rear view of the bag assembly, and shows attachment devices 14 that can attach the mounting structure 10 to a surface. The attachment devices 14 may, as shown in FIG. 3, include an adhesive layer 142, which may be a single layer or part of an adhesive structure such as double-sided tape or the like. The adhesive of the adhesive layer 142 should be strong enough to securely mount the mounting structure 10 to a mounting surface such as a car dash or the like, but is preferably not so strong that a permanent residue, mark or the like is left when the mounting structure 10 is pulled off of the mounting surface and discarded. As also shown in FIG. 3, the attachment devices 14 may also include a release layer 144, such as a waxed paper or plastic sheet or the like, that releasably adheres to the adhesive layer 142 to prevent the adhesive layer from drying before use and/or being contaminated by dirt or the like. The release layer 144 is peeled off and discarded prior to attaching the mounting structure 10 to a mounting surface.

FIG. 3 shows a cross-sectional view along line 3—3 of FIG. 1. Bag structures 20 re stacked upon top of each other inside the mounting structure 10, and one end of each bag structure 20 is attached to an adjacent bag structure 20 in a way that allows the bag structures 20 to be separated from each other without destroying a bag portion of the bag structures 20. For example, adhesive layers 30 may be used to hold the bag structures 20 together. When adhesive layers 30 are used, the adhesive of the adhesive layers 30 should be fairly strong so that the bag structures 20 are properly held in position. However, when an adhesive layer 30 contacts a bag portion of a bag structure 20, i.e., a portion of the bag structure 20 that will hold trash, the adhesive should not be so strong that the bag portion is damaged when the adjacent bag structure 20 is pulled off.

The stack of bag structures 20 may be fastened to the mounting structure 10 by a fastener 40, which may also be an adhesive strip or other suitable fastener. Fastening the bag structures 20 together and/or to the mounting structure 10 has the following advantages. First, when the bag dispensing assembly is mounted with the mounting structure 10 in an upright position, the bag structures 20 are prevented from sagging or collapsing downward. Second, when each bag structure is folded upon itself one or more times, attaching one end as shown allows the folded bags to be easily compressed and, when a user removes one bag structure 20, retains the remaining bag structures 20 in place.

The mounting structure 10 may have any desired dimensions, but when the bag dispensing assembly is used in a small area such as an automobile interior, where space is limited, a smaller mounting structure is preferable. Thus, for small-area applications, the mounting structure preferably has a maximum dimension in any given direction of about 6" or less, and more preferably about 4.5" or less. One dimension of the mounting structure 10 is preferably about 1" or less, and more preferably about 0.5" or less. This dimension of 1" or less is preferably the thickness dimension, or in other words, the dimensional in the vertical direction of FIG. 3. For example, one suitable set of dimensions of the mounting structure 10 is 3"×4.5"×0.5".

The bag structures 20 may be conventional bags, such as thin-walled plastic bags or the like, or may have a structure as described below.

Figure 4:
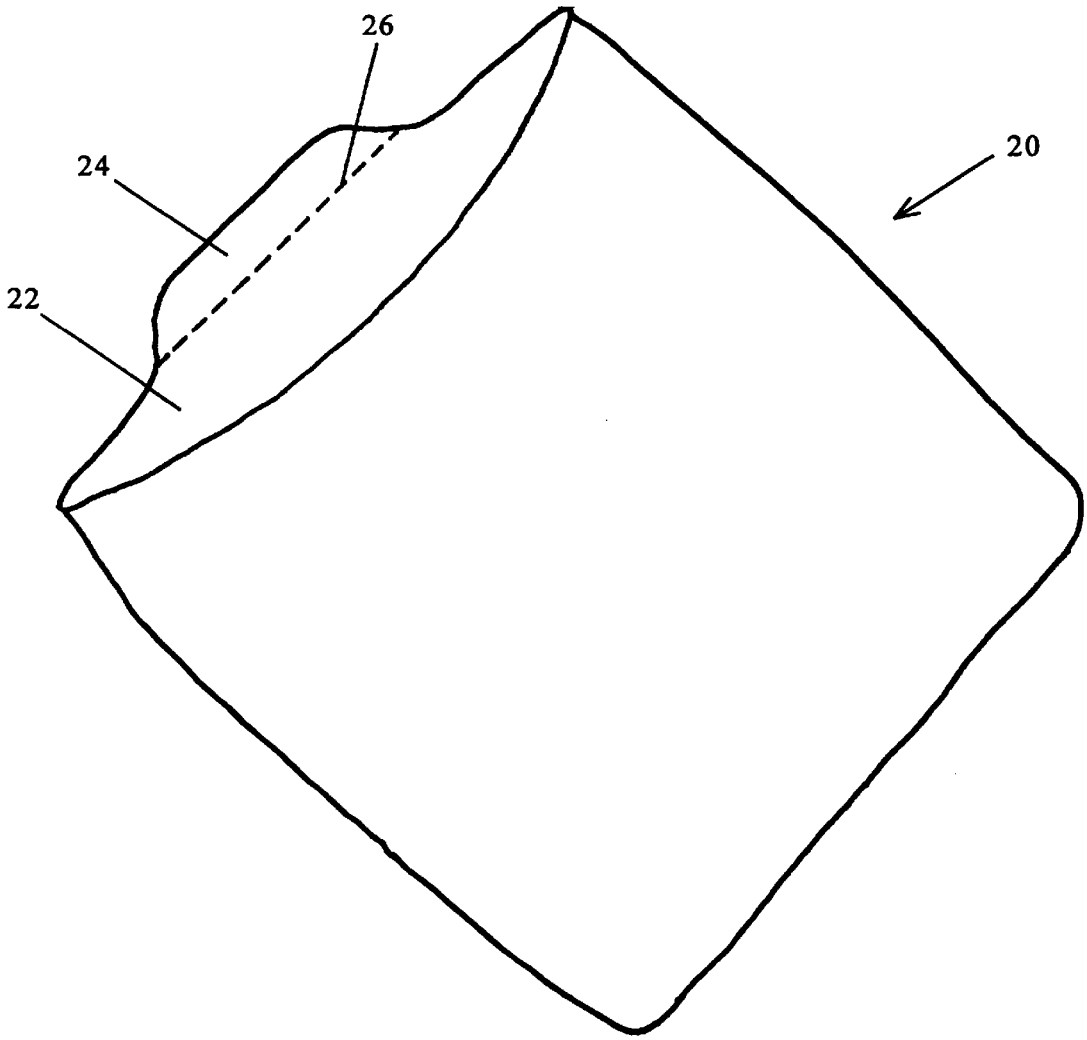
FIG. 4 shows a perspective view of a bag structure.

FIG. 4 shows a perspective view of a bag structure 20 according to one embodiment of the invention. The bag structure 20 includes a bag portion 22 and an attachment portion 24. The bag portion 22 may be detachable from the attachment portion 24. For example, a perforation 26 or the like may be provided between the bag portion 22 and the attachment portion 24.

Figure 5:
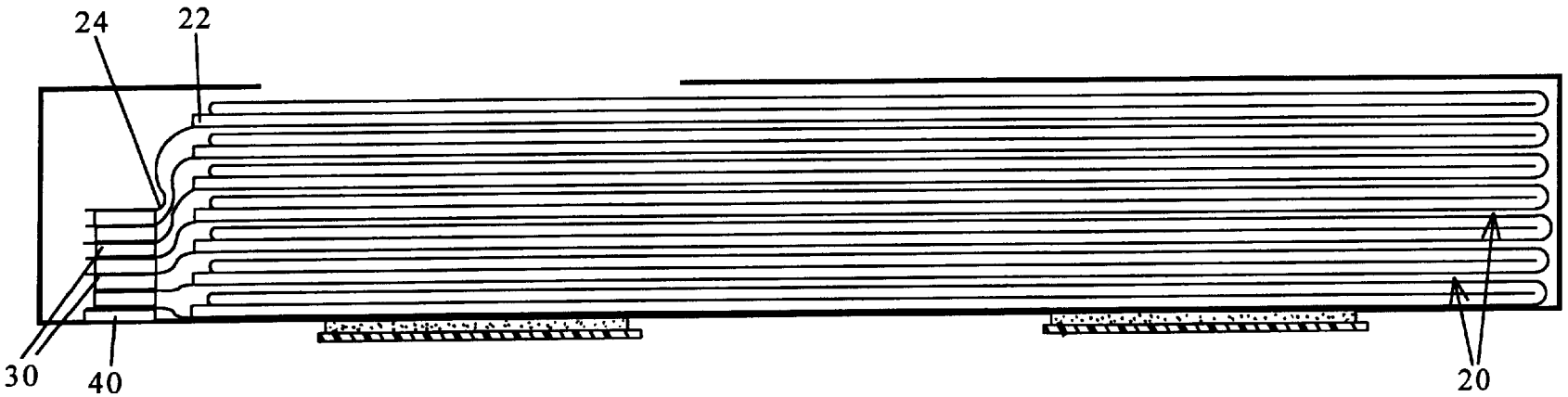
FIG. 5 shows a cross sectional view of a bag assembly including a plurality of the bag structures of FIG. 4.

FIG. 5 shows a cross sectional view of a bag assembly including a plurality of the bag structures of FIG. 4. The bag dispensing assembly is otherwise the same as the bag dispensing assembly of FIGS. 1–3.

As shown in FIG. 5, the bag portions 22 of the bag structures 20 are each folded upon themselves, and the attachment portions 24 of all of the bag structures 20 are attached together. The attachment portions 24 are shown attached together by adhesive layers 30, and the attachment portions 24 are shown collectively attached to the mounting structure 10 by a fastener 40. However, it should be appreciated that, at least in this embodiment, the attachment portions 24 may be attached together in other ways, such as by being fused together by ultrasonic welding or the like. Additionally or alternatively, the attachment portions may be attached together and/or to the mounting structure 10 by screws, rivets or the like.

Figure 6:
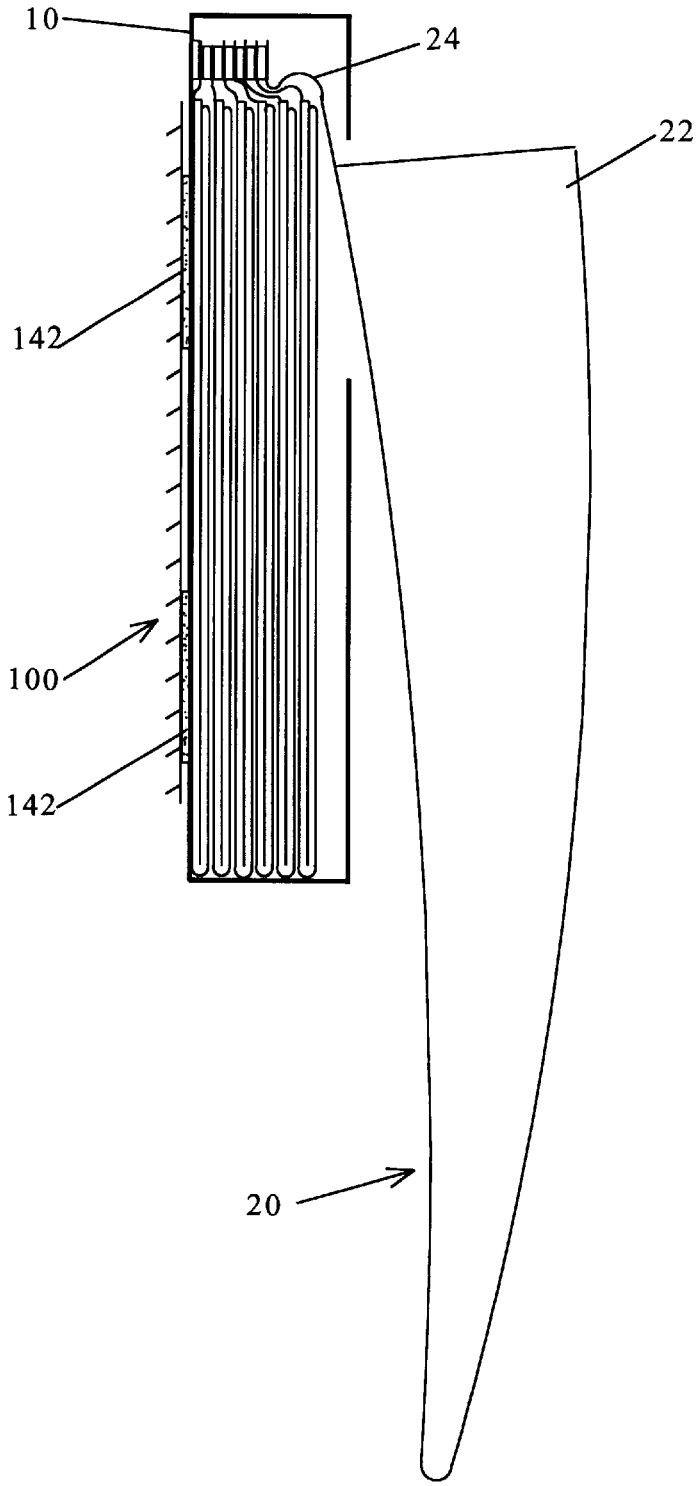
FIG. 6 shows the bag dispensing assembly of FIG. 5 with one bag structure in a deployed state.

FIG. 6 shows a possible deployment state of a bag structure 20 according to this invention. Specifically, FIG. 6 shows a cross sectional view of the bag dispensing assembly of FIG. 5, with the release layers 144 removed and the bag dispensing assembly attached to a mounting surface 100 by the adhesive strips 142. One bag structure 20 is in a deployed state. It is possible, of course, to entirely remove one bag structure 20 from the bag dispensing assembly, and then fill and dispose of the bag structure 20. However, as shown in FIG. 6, the attachment portion 24 of the outermost bag structure 20 may be left attached to the bag dispensing assembly, and the bag portion 22 of the bag structure pulled out of the mounting structure 10 and unfolded into a deployed state. Then, trash may be deposited into the bag portion 22 on an ongoing basis, and when the bag portion 22 is full, it may be detached from the bag dispensing assembly and discarded. The next bag structure 20 may then be unfolded into the deployed state.

After the last bag structure 20 has been removed from the mounting structure 10, the mounting structure 10 may be removed and discarded, and replaced by a new mounting structure 10 with more bag structures 20.

While the invention has been described in conjunction with the specific embodiments described above, many equivalent alternatives, modifications and variations will become apparent to those skilled in the art once given this disclosure. Accordingly, the exemplary embodiments of the invention as set forth above are considered to be illustrative and not limiting. Various changes to the described embodiments may be made without departing from the spirit and scope of the invention.

For example, in FIG. 4, the attachment portions 24 are detachable from the bag portions 22, but it is also acceptable for the attachment portions 24 to not be detachable from the bag portions 22. In this case, the attachment portion 24 of each bag structure 20 would be pulled off along with the bag portion 22 when the bag structure 20 was removed from the bag dispensing assembly.

Although a unique bag structure 20 is shown for the bag dispensing assembly shown in FIGS. 5 and 6, it should be appreciated that a conventional bag structure may also be used. In this case, one side of the opening end of each bag would serve as an attachment structure to attach to adjacent bags.

Furthermore, although a box is shown as the mounting structure 10, it should be appreciated that other mounting structures are possible. For example, the mounting structure 10 could simply be a substrate, such as cardboard or the like, to which the bag structures 20 are attached.

What is claimed is:

1. A bag dispensing assembly, comprising:

a plurality of bag structures arranged in a stack with corresponding ends of the bag structures aligned, one end of each bag structure being releasably attached to a corresponding end of an adjacent bag structure;

a mounting structure that holds the stack of bag structures in a specified position relative to a first side of the mounting structure; and an attachment device that attaches the mounting structure to a mounting surface, the attachment device being fastened to a second side of the mounting structure opposite the first side.

2. The bag dispensing assembly according to claim 1, wherein the attachment device comprises an adhesive layer.

3. The bag dispensing assembly according to claim 2, further comprising a release layer attached to a side of the adhesive layer that faces away from the mounting structure.

4. The bag dispensing assembly according to claim 1, further comprising a constraining structure that positionally constrains the stack of bag structures relative to the mounting structure and allows a single bag at a time to be removed from mounting structure without removing the entire stack.

5. The bag dispensing assembly according to claim 4, wherein the constraining structure comprises a fastener that fastens the stack of bag structures to the mounting structure.

6. The bag dispensing assembly according to claim 1, wherein each bag structure comprises a bag portion and an attachment portion, and the attachment portions correspond to the attached ends of the bag structures.

7. The bag dispensing assembly according to claim 6, further comprising a detachment facilitation structure that facilitates detachment of each bag portion from a respective attachment portion.

8. The bag dispensing assembly according to claim 7, wherein the detachment facilitation structure comprises a perforation between each bag portion and respective attachment portion.

9. The bag dispensing assembly according to claim 7, wherein an opening end of each bag portion is attached to a respective attachment structure.

10. The bag dispensing assembly according to claim 1, the bag assembly having a dimension in one direction of about 1" or less.

11. The bag dispensing assembly according to claim 1, the bag assembly having a dimension in one direction of about 0.5" or less.

12. The bag dispensing assembly according to claim 1, wherein a largest dimension of the bag assembly is about 6" or less.

13. The bag dispensing assembly according to claim 1, wherein a largest dimension of the bag assembly is about 4.5" or less.

14. The bag dispensing assembly according to claim 1, wherein each bag structure is folded upon itself at least one time.

15. The bag dispensing assembly according to claim 1, wherein the mounting structure comprises a box, an opening being formed in the box through which to remove the bag structures.

16. The bag dispensing assembly according to claim 1, wherein the one end of each bag structure is attached to the corresponding end of the adjacent bag structure in a way that does not damage either bag structure when the bag structures are separated.

17. The bag dispensing assembly according to claim 1, wherein the one end of each bag structure is attached to the corresponding end of the adjacent bag structure by an adhesive.

18. The bag dispensing assembly according to claim 17, wherein the adhesive is in the form of an adhesive strip.

19. The bag dispensing assembly according to claim 15, wherein the second side of the mounting structure is an outer side of a back wall of the box, and at least part of the opening is formed in a front wall of the box opposite the back wall.

20. The bag dispensing assembly according to claim 15, wherein the second side of the mounting structure is an outer side of a back wall of the box, and the opening is formed only in a front wall of the box opposite the back wall.

* * * * *